United States Patent [19]

Iwasa

[11] 4,122,809

[45] Oct. 31, 1978

[54] AIR-FUEL RATIO CONTROL SYSTEM

[75] Inventor: Yoshio Iwasa, Nagareyama, Japan

[73] Assignee: Nissan Motor Company, Limited, Yokohama, Japan

[21] Appl. No.: 736,231

[22] Filed: Oct. 27, 1976

[30] Foreign Application Priority Data

Oct. 28, 1975 [JP] Japan ..... 50-129652

[51] Int. Cl.[2] ..... F02B 33/00; F02M 7/00; F02B 75/10

[52] U.S. Cl. ..... 123/119 EC; 123/119 D; 173/124 R

[58] Field of Search ..... 123/119 EC, 32 EE, 119 D, 123/124 R, 124 B, 124 A; 60/276

[56] References Cited

U.S. PATENT DOCUMENTS

| | | | |
|---|---|---|---|
| 3,745,768 | 7/1973 | Zechnall et al. | 173/32 EE |
| 3,827,237 | 8/1974 | Linder et al. | 123/32 EE |
| 3,874,171 | 4/1975 | Schmidt et al. | 123/32 EE |
| 3,895,611 | 7/1975 | Endo et al. | 123/32 EE |
| 3,942,493 | 3/1976 | Linder et al. | 123/119 EC |
| 3,949,551 | 4/1976 | Eichler et al. | 123/32 EE |

*Primary Examiner*—Wendell E. Burns
*Attorney, Agent, or Firm*—Bacon & Thomas

[57] ABSTRACT

An internal combustion engine is equipped with an air-fuel ratio controlling device which monitors at least one exhaust gas component and adjusts the air-fuel ratio according to detection of the component. It is, however, desirable to operate the device only when the engine is warmed up. Accordingly, a system is provided to prevent control by the device until the engine is warmed up. The system includes thermal switches which monitor intake air temperature and coolant temperature. These switches close at selected temperatures so as to allow the air-fuel ratio device to control the air-fuel ratio. Prior to closing the switches, an enriched air-fuel ratio, necessary for starting and running cold engines, is provided.

10 Claims, 4 Drawing Figures

AIR-FUEL RATIO CONTROL SYSTEM

BACKGROUND OF THE INVENTION

The present invention relates generally to an air-fuel ratio control system for controlling the air-fuel ratio of an air-fuel mixture formed for an engine so as to match to a desired air-fuel ratio.

As is well known in the art, when an engine's exhaust system is equipped with a catalytic converter which includes a ternary or three-way catalyst that catalytically and concurrently effects oxidation of hydrocarbons (HC) and carbon monoxide (CO) and reduction of nitrogen oxides (NOx) to convert these noxious components to harmless components, it is necessary, for effectively increasing the amount of noxious components converted by the ternary catalyst, to control the air-fuel ratio of an air-fuel mixture burned in the engine so as to approach as closely as possible the a stoichiometric air-fuel ratio.

In order to solve the aforementioned problem, an air-fuel ratio control system is proposed which controls the air-fuel ratio of an air-fuel mixture formed by a carburetor of an engine to a desired air-fuel ratio by sensing the concentration of a component contained in exhaust gas of the engine. However, air-fuel ratios which are optimum for the output performance of the engine and which are optimum for increasing the amount of noxious components converted by an exhaust gas purifying device of the engine are different from one another in accordance with operating conditions of the engine. More particularly, when the engine is fed with an air-fuel mixture having a stoichiometric air-fuel ratio during cold conditions of the engine, the driveability of the engine is unstable making it difficult to start the engine and to continue to run the engine after starting.

SUMMARY OF THE INVENTION

It is, therefore, an object of the invention to provide an air-fuel ratio control system which comprises means for stopping, or interrupting, control of the air-fuel ratio of an air-fuel mixture formed for an engine so as to obtain a desired air-fuel ratio during cold conditions of the engine wherein said system also enriches the air-fuel mixture when the engine is cold.

With the foregoing object, and other objects in mind, the instant invention contemplates an air-fuel ratio control system in combination with an internal combustion engine. The engine has a carburetor with an intake passageway that has a fuel supply passage in communication therewith. Fuel is drawn into the intake passageway to form an air-fuel mixture for charging the engine.

An air bleed passage communicating with the atmosphere and with the fuel supply passage is controlled by a solenoid operated control valve that controls the flow of air drawn into the fuel supply passage through the air bleed passage.

The air fuel ratio control system also includes a sensing means for sensing a parameter related to the concentration of an exhaust gas component.

A control circuit is electrically connected to both the solenoid operated control valve and to the sensing means and generates a control signal in accordance with the value of the parameter sensed by the sensing means. In response to the control signal, the control valve moves into a position to vary the flow of air and thereby vary the flow of fuel drawn from the fuel supply passage into the intake passageway so as to match the air-fuel ratio of an air-fuel mixture formed by the carburetor to a desired air-fuel ratio.

Switch means is located in an electrical circuit connecting the control circuit to the solenoid. The switch means closes in response to engine temperatures above a predetermined value and opens in response to temperatures of the engine which are below a predetermined value. In response to opening of the electrical circuit, or rather to an open condition of the electric circuit, the control valve means moves into a position to reduce the flow of air and to thereby increase the flow of fuel causing the carburetor to operate with a relatively enriched air-fuel mixture.

BRIEF DESCRIPTION OF THE DRAWINGS

The aforementioned object and other objects and advantages of the invention will become more apparent from the following detailed description taken in connection with the accompanying drawings in which.

DETAILED DESCRIPTION OF THE DRAWINGS

Figure 1:
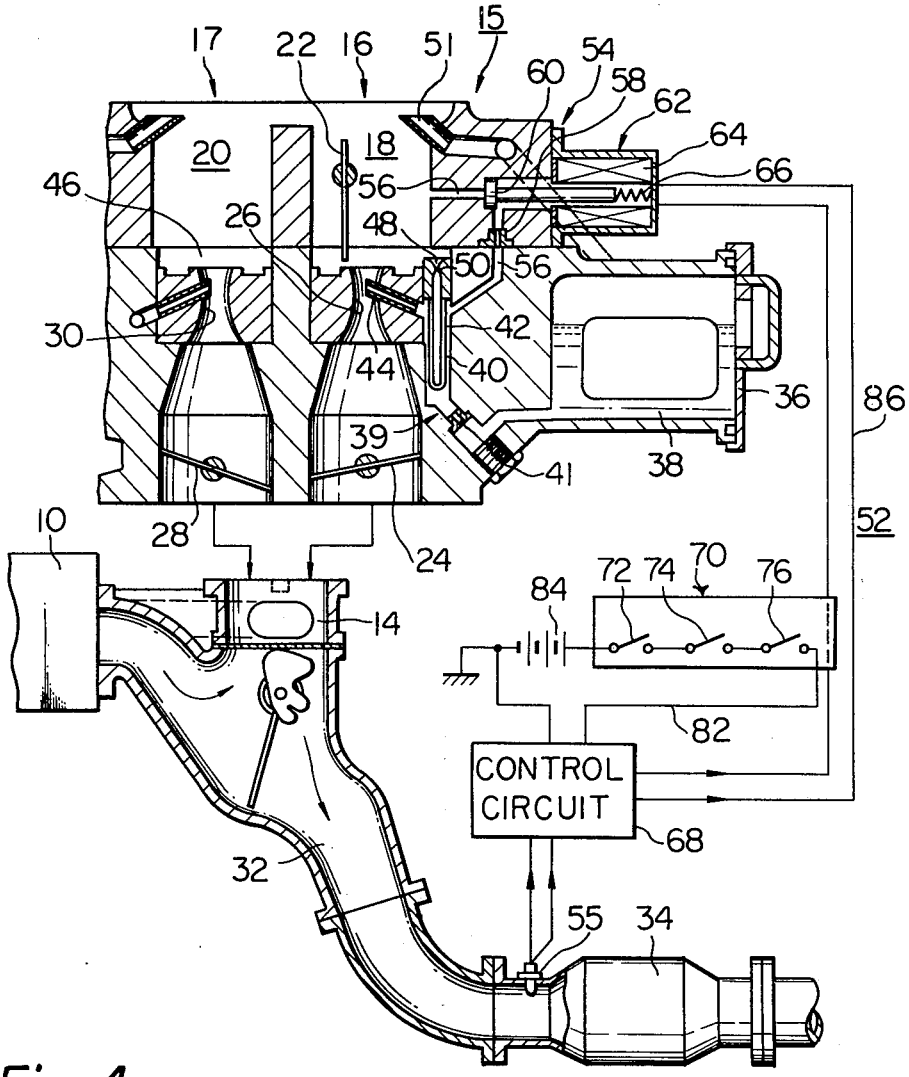
FIG. 1 is a schematic cross sectional view of a preferred embodiment of an air-fuel ratio control system according to the invention.

Referring to FIG. 1 of the drawings, there is shown an internal combustion engine 10 and an air-fuel ratio control system according to the invention which is combined with the engine 10. The engine 10 includes an intake passageway 14 for providing communication between an intake port (not shown) of the engine 10 and the atmosphere and a twin-barrel carburetor 15 including primary and secondary sides 16 and 17. The primary side 16 includes a primary intake passageway 18 forming a part of the intake passageway 14 and having a choke valve 22 and a primary throttle valve 24 both rotatably mounted therein, with a primary venturi 26 formed therebetween. The engine 10 also includes an exhaust gas passageway 32 for providing communication between an exhaust port (not shown) of the engine 10 and the atmosphere, and an exhaust gas purifying device 34, such as an exhaust gas reburning device or a catalytic converter, located in the exhaust gas passageway which oxidizes noxious burnable components, such as hydrocarbons (HC) and carbon monoxide (CO) contained in exhaust gas of the engine 10 in order to purify the engine exhaust gas. The catalytic converter 34 may include a ternary of three-way catalyst which serves to concurrently and catalytically effect both oxidation of hydrocarbons and carbon monoxide and to reduce nitrogen oxides ($NO_x$) present in the engine exhaust gas.

The primary side 16 of the carburetor 15 also includes a fuel bowl or float chamber 36 containing liquid fuel 38 therein and a main system 39 having a main fuel passageway 40 communicating with the fuel bowl 36. The main system 39 includes a jet 41 therein for metering the flow of fuel passing therethrough, a main emulsion or mixing tube 42 communicating with and formed in the main fuel passageway 40, a primary fuel nozzle 44 communicating with the mixing tube 42 and opening into the primary venturi 26, and a main air bleed passage 48 communicating with the atmosphere and with the mixing tube 42. Air is drawn into the mixing tube 42 to emulsify fuel drawn from the man fuel passage 40 into the intake passageway 18. An orifice 50 is provided for metering the flow of air drawn into the mixing tube 42. The fuel bowl 36 has a vent tube 51 communicating therewith and with the atmosphere. Although the secondary side 17 of the carburetor 15 is constructed similarly to the primary side 16, the description thereof is omitted for purpose of simplicity. Also, although the primary side 16 of the carburetor 15 includes an idling and slow running system the description and illustration thereof are omitted from FIG. 1 for purpose of simplicity.

The air-fuel ratio control system, generally designated by the reference numeral 52, serves to control the air-fuel ratio of an air-fuel mixture for combustion in a combustion chamber (not shown) of the engine 10 or to control an overall air-fuel ratio to a desired air-fuel ratio which is, for example, a stoichiometric air-fuel ratio when the exhaust gas purifying device 34 is a catalytic converter having a three-way or .riple catalyst. The air-fuel ratio control system 52 comprises fuel flow control means 54 and sensing means 55. The fuel flow control means 54 is combined with the carburetor 16 and comprises an additional air bleed passage 56 communicating with the atmosphere and with the mixing tube 42 to feed thereinto additional air. The passage 56 has formed therein an orifice 58 for metering the flow of air drawn thereinto. A control valve 60 is located to close and open the additional air bleed passage 56, and operating means 62 causes the control valve 60 to open and close the air bleed passage 56. The operating means 62 comprises a solenoid 64 and a spring 66 urging the control valve 60 into a position to close the air bleed passage 56. The solenoid 64 is positioned with respect to the control valve 60 so that when the solenoid 64 is energized and deenergized, the control valve 60 opens and closes the air bleed passage 56, respectively, in this embodiment. The sensing means 55 is located in the exhaust gas passageway 32 upstream of the exhaust gas purifying device 34 and senses the concentration of a component such as, for example, oxygen ($O_2$), carbon monoxide (CO), carbon dioxide ($CO_2$), hydrocarbon (HC) or nitrogen oxide ($NO_x$) contained in exhaust gas of the engine 10, which concentration represents a function of the air-fuel ratio of the air-fuel mixture burned in a combustion chamber of the engine 10 or the overall air-fuel ratio. The sensing means 55 is, for example, an oxygen sensor, carbon monoxide sensor, carbon dioxide sensor, hydrocarbon sensor or nitrogen oxide sensor. The sensor 55 generates an electrical output signal representative of the sensed concentration of the component. An electronic control circuit 68 is provided which is electrically connected to the sensor 55 to receive the output signal thereof. The control circuit 68 compares the output signal of the sensor 55, that indicative of the sensed air-fuel ratio, with a reference signal representative of the desired air-fuel ratio and generates first and seecond electrical output signals for enriching and diluting the air-fuel mixture for the engine 10, when the sensed air-fuel ratio is higher or lower, respectively, than the desired air-fuel ratio. The control circuit 68 is electrically connected to the solenoid 64 to apply first and second output signals thereto. The solenoid 64 is deenergized allowing the spring 66 to move the control valve 60 into the position to close the additional air bleed passage 56 in response to the first output signal of the control circuit 68. When the air bleed passage 56 is closed by the control valve 60 in this manner, additional air is prevented from being drawn through the air bleed passage 56 into the main fuel passage 40. This increases the flow of fuel drawn from passage 40 into the intake passageway 14 by a quantity proportional to the additional air prevented from being drawn by closing passage 56 thereby causing the carburetor 16 to form an enriched air-fuel mixture for charging the engine 10. In this instance, the air bleed passage 48 serves to make it easy to adjust the air-fuel ratio of the enriched air-fuel mixture and prevent the mixture from being excessively enriched.

The solenoid 64 is energized to move the control valve 60 into a position to open the additional air bleed passage 56 in opposition to the force of the spring 66 and in response to receipt of the second output signal of the control circuit 68. When the air bleed passage 56 is opened by the control valve 60 in this manner, additional air is drawn through the air bleed passage 56 and into the main fuel passage 40 to thereby reduce the flow of fuel drawn therefrom and passed into the intake passageway 14. This reduction is proportioned to the share of the additional air drawn to cause the carburetor 16 to form a diluted air-fuel mixture. In this manner, the air-fuel ratio of the air-fuel mixture formed by the carburetor 16 is controlled to the desired air-fuel ratio. Similar fuel flow control means (not shown) may be provided for the idling and slow running system to control the air-fuel ratio of an air-fuel mixture formed thereby to the desired air-fuel ratio.

Figure 4:
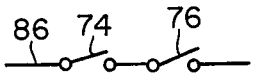
FIG. 4 is a schematic view of an alternative arrangement for an electrical circuit including two switches and which can form part of the air-fuel ratio control system shown in FIG. 1.
Figure 2:
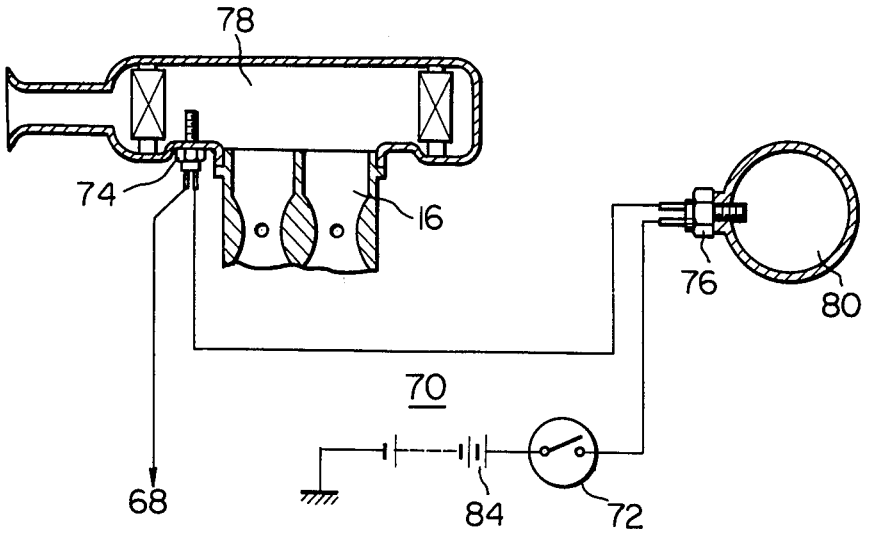
FIG. 2 is a schematic view of an example of an arrangement of two temperature sensing switches forming part of the air-fuel ratio control system shown in FIG. 1.

The air-fuel ratio control system 52 is provided with control means, designated generally by the numeral 70, for disabling or rendering the control system inoperative during operation of the engine 10 when cold. The control means 70 comprises means for sensing a cold or warming-up condition of the engine 10. As seen in FIG. 2, the sensing means 70 comprises an ignition switch 72 and two temperature switches 74 and 76 the three of which are connected in series. The ignition switch 72 is closed and opened when the engine 10 running and not running, respectively. The temperature switch 74 is provided for sensing the temperature of air drawn into the engine 10 and is located in, for example, an air cleaner 78 of the engine 10, as shown in FIG. 2 of the drawings. The switch 74 is opened and closed when the temperature of the engine taken air is below and above a predetermined value such as, for example, 30° C., respectively. The temperature switch 76 is provided for sensing the temperature of a coolant of the engine 10 and is located in, for example, a passage means 80 of the engine cooling system, as is shown in FIG. 2. The switch 76 is opened and closed when the temperature of the engine coolant is below and above, respectively, a predetermined value such as, for example, 65° C. The sensing means 70 is included in an electric power supply circuit 82 which has an electric power source 84 connected to the control circuit 68. When at least one of the switches 72, 74 and 76 is opened, the control means 70 disenables control circuit 68 so that it cannot control the air-fuel ratio to obtain the air-fuel ratio desired when the engine is warm. This is because the control circuit 68 can not then generate an output signal to power the solenoid 64 so as to overcome the bias of spring 66. The enrichment of the air-fuel mixture for the engine 10 is therefor high because additional air is not flowing through passage 56. In essence, the control means 70 divides the wiring of circuit 82 into two sections which are connected to let power from source 84 power the control circuit 68 upon closing the thermal switches 74 and 76. Alternatively, as shown in FIG. 4, the switches 74 and 76 may be included in an electric circuit 86 for interconnecting the solenoid 64 and the control circuit 68. Also, one of the switches 74 and 76 may be dispensed with. In essence, the switches 74 and 76 divide the wiring of the electric circuit 86 into two sections which are connected to let power flow to the solenoid 64 upon closing the switches.

Figure 3:
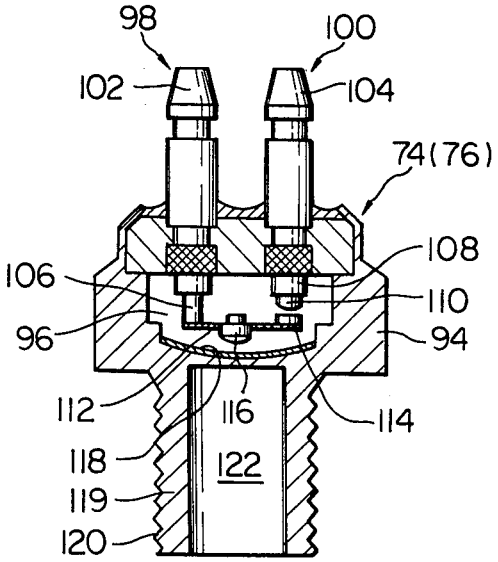
FIG. 3 is a schematic cross sectional view of an example of the temperature sensing switch shown in FIGS. 1 and 2.

Referring to FIG. 3 of the drawings, there is shown an example of a switch having a structure similar to the switches 74 and 76. As shown in FIG. 3, the switch comprises a casing 94 made of a good heat conductive metal such as, for example, brass which has therein a switch chamber 96. First and second electrical conductors 98 and 100 extend from the outside of the casing 94 into the switch chamber 96 and have first and second terminals 102 and 104 located externally of the casing 94 and internal ends 106 and 108 located within the switch chamber 96, respectively. A stationary contact 110 is fixedly mounted on the end 108 of the second conductor 100. An electric conductive arm 112 is fixedly connected at one end with the end 106 of the first conductor 98. The arm 112 has a free end on which a contact 114 is fixedly mounted in juxtaposition with the stationary contact 110 so as to be engageable with it. A projection 116 is fixedly secured on the arm 112 at its mid portion. A bimetallic member 118 is located in the switch chamber 96 adjacent to the projection 116. The casing 94 has a stem portion 119 formed in its external surface with a screw thread 120 for insertion into the engine part such as the air cleaner 78 or the passage means 80. The stem portion 119 is formed with a bore 122 therein which is located adjacent to the bimetallic member 118 and is separated from the switch chamber 96. The bore 122 serves to minimize the heat capacity of the casing 94 and is filled with the engine coolant or intake air to transmit the heat thereof to the bimetallic member 118 as quickly as possible when the switch is connected to the passage means 80 or the air cleaner 78. The arm 112 is biased by its elastic force into a position to disengage the movable contact 114 from the stationary contact 110. The bimetallic member 118 is so positioned that the arm 112 is in a position to disengage the movable contact 114 from the stationary contact 110 to open the switch when the temperature of the engine coolant or taken air is below the predetermined value. As the temperature of the engine coolant or intake air is increased, the bimetallic member 118 bends toward the arm 112 and engages the projection 116 to move the arm 112 into a position in which the movable contact 114 engages the stationary contact 110 to close the switch when the temperature of the engine coolant or taken air is above the predetermined value.

The air-fuel ratio control system 52 thus far described is operated as follows:

When the ignition switch 72 is closed to start the engine 10 and when the temperature of air drawn to the engine 10 is below the predetermined value, the switch 74 is open. When the temperature of the engine coolant is below the predetermined value, the switch 76 is open. When at either one of the switches 74 and 76 is open, the electric power source 84 is disconnected from the control circuit 68 to stop supply of an electric current to control circuit 69. This renders the control circuit 68 inoperative so as to stop supply of an energizing signal to the solenoid 64. As a result, the solenoid 64 is continuously deenergized and allows the spring 66 to force the control valve 60 into position to close the additional air bleed passage 56. This causes an increase in the amount of fuel drawn from the main fuel passage 40 into the intake passageway 18, or both the intake passageways 18 and 20, so as to form an enriched air-fuel mixture for the engine 10. In this instance, it is usually necessary to reduce the air-fuel ratio of the air-fuel mixture to about 13:1 (by weight) when gasoline is employed as fuel. This is to compensate for an increased amount of fuel in the air-fuel mixture, which fuel is not gasified and to prevent misfiring of the air-fuel mixture in a combustion chamber of the engine when the temperature of air taken into the engine and/or of the engine coolant is below the predetermined values so that an engine continues to run smoothly after it has starts. Such an enriched air-fuel mixture can be obtained by closing the choke valve 22 when the control of the air-fuel ratio is not occurring.

When the engine 10 is warmed up so that both switches 74 and 76 are closed, the control circuit 68 is rendered operative to generate an energizing signal or a deenergizing signal or to either supply an electric current or not to supply electric current to the solenoid 64, when the sensor 55 senses the air-fuel ratios lower or higher, respectively, than the desired air-fuel ratio. As a result, the solenoid 64 is energized and deenergized to cause the control valve 60 to open and close respectively the air bleed passage 56 to correct the air-fuel ratio of the air-fuel mixture burned in the engine 10 to the desired air-fuel ratio. Thus, the exhaust gas purifying device 34 operates most efficiently and satisfactorily performs reduction and/or oxidation of noxious components present in exhaust gas of the engine 10.

It will be appreciated that the invention provides an air-fuel ratio control system which is cut off when the engine is cold so that it can not control the air-fuel ratio of an air-fuel mixture for an engine so as to match that ratio with air-fuel ratio desired when the engine is warm when the engine is cold the air-fuel mixture is enriched by simple means which causes a control valve to close an additional air bleed passage through deenergization of a solenoid. The solenoid is deenergized by stopping supply of electric current thereto, without employing or providing an electronic control circuit accordingly, it is rendered possible to surely start the engine and to continue to run the engine after it starts. The construction of the system is these by simplified and the production cost thereof is reduced.

What is claimed is:

1. An air-fuel ratio control system in combination with an internal combustion engine including a carburetor having:

an intake passageway and fuel supply passage means which communicates with the intake passageway and from which fuel is drawn into the intake passageway to form an air-fuel mixture; said air-fuel ratio control system comprising:

sensing means for sensing a parameter related to the concentration of a component contained in exhaust gases of the engine, air bleed passage means communicating with the atmosphere and with the fuel supply passage means, control valve means movably located relative to said air bleed passage means for controlling the flow of air drawn into the fuel supply passage means through said air bleed passage means, solenoid means for operating said control valve means, control circuit means electrically connected to said sensing means for generating a control signal in accordance with the value of said parameter sensed by said sensing means, siad solenoid means being electrically connected to said control circuit means for causing, in response to said control signal, said control valve means to move into a position in which said control valve means varies the flow of said air thereby varying the flow of fuel drawn from the fuel supply passage means into the intake passageway and to thereby control the air-fuel ratio of an air-fuel mixture formed by the carburetor to a desired air-fuel ratio, an electrical circuit means connecting said control circuit to said solenoid means, switch means, responsive to the temperature of the engine and located in said electrical circuit, for closing said electrical circuit in response to temperatures of the engine which are above a predetermined value and for opening said electrical circuit in response to temperatures of the engine which are below said predetermined value, and means for causing, in response to an open condition of said electric circuit, said control valve means to move into a position in which said control valve means reduces the flow of said air thereby to increase the flow of said fuel and to have the carburetor form an enriched air-fuel mixture.

2. An air-ratio control system as claimed in claim 1 in which said switch means further comprises a first normally open switch included in said electric circuit and which is closed in response to a temperature of air drawn into of the engine above a first predetermined value to close said electric circuit, and a second normally open switch included in said electric circuit in series with said first switch and closed in response to a temperature of a coolant of the engine above a second predetermined value to close said electric circuit.

3. An air-fuel ratio control system as claimed in claim 2, in which said second switch comprises a casing made of a good heat conductive material and formed therein with a switch chamber, first and second electric conductors having first and second terminals both located outside said casing and first and second internal ends both located inside said switch chamber, an electric conductive arm fixedly secured at an end to said first internal end and having a free end facing said second internal end, stationary and movable contacts fixedly secured respectively to said second internal end and said free end and engageable with each other, a projection mounted on said arm at its mid portion, a bimetallic member located in said switch chamber to face said projection and bent away from said projection in response to a temperature of a coolant of said engine below said second predetermined value to move said arm into a position in which said movable contact is disengaged from said stationary contact and bent to engage said projection in response to a temperature of said engine coolant above said second predetermined value to cause said arm to move into a position in which said movable contact engages said stationary contact, and a stem portion which has means for being inserted in passage means of said engine coolant and which is formed thein with a bore which extends toward said switch chamber and into which said engine coolant is admitted to transmit heat of said engine coolant to said bimetallic member.

4. An air-fuel ratio control system as claimed in claim 2, in which said first switch comprises a casing made of a good heat conductive material and formed therein with a switch chamber, first and second electrical conductors having first and second terminals both located outside said casing, and first and second internal ends both located inside said switch chamber, an electrical conductive arm fixedly secured at an end to said first internal end and having a free end facing said second internal end, stationary and movable contacts fixedly secured respectively to said second internal end and said free end and engageable with each other, a projection mounted on said arm at its mid portion, a bimetallic member located in said switch chamber to face said projection and bent away from said projection in response to a temperature of air drawn into the engine below said first predetermined value to move said arm into a position in which said movable contact is disengaged from said stationary contact and bent to engage said projection in response to a temperature of said air above said first predetermined value to cause said arm to move into a position in which said movable contact engages said stationary contact, and a stem portion which has means for being inserted in passage means of said air and which is formed therein with a bore which extends toward said switch chamber and into which said air is admitted to transmit heat of said air to said bimetallic member.

5. The air-fuel ratio control system of claim 2 wherein the first and second switches are juxtaposed with the engine cooling system and the engine air intake system, respectively.

6. An air-fuel ratio control system in combination with an internal combustion engine including a carburetor having:

an intake passageway and fuel supply passage means communicating with a fuel source and with the intake passageway and from which fuel is drawn into the intake passageway to form an air-fuel mixture, said air-fuel ratio control system comprising:

sensing means for sensing a parameter related to the air-fuel ratio of an air-fuel mixture formed by the carburetor, air bleed passage means communicating with the atmosphere and with said fuel supply passage means, control valve means movable located relative to said air bleed passage means for controlling the flow of air drawn into said fuel supply passage means through said air bleed passage means, said control valve means having first and second positions in which said control valve means closes and opens said air bleed passage means thereby to increase and reduce the flow of fuel drawn from said fuel supply passage means into the intake passageway and to reduce and increase the air-fuel ratio of an air-fuel mixture formed by the carburetor to a predetermined air-fuel ratio, respectively, solenoid means for operating said control valve means, control circuit means electrically connected to said sensing means for generating a first signal in response to said parameter sensed by said sensing means which parameter has values corresponding to air-fuel ratios above said predetermined air-fuel ratio and a second signal in response to said parameter sensed by said sensing means which parameter has values corresponding to air-fuel ratios below said predetermined air-fuel ratio, said solenoid means being electrically connected to said control circuit means for, in response to said first and second signals, causing said control valve means to move into said first and second positions, respectively, an electric power source, wiring means for electrically interconnecting said electric power source to said control circuit means for delivering electric power from said source to operate said control circuit means, switch means responsive to the temperature of the engine and located in said wiring means to divide it into two sections said switch means connecting said two sections to each other in response to temperatures of the engine which are above a predetermined value and disconnecting said two sections from each other in response to temperatures of the engine which are below said predetermined value, and means for causing said control valve means to move into said first position in response to a disconnected condition of said two sections.

7. An air-fuel ratio control system in combination with an internal combustion engine including a carburetor having:

an intake passagway and fuel supply passage means communicating with a fuel source and with the intake passageway and from which fuel is drawn into the intake passageway to form an air-fuel mixture, said air-fuel ratio control system comprising sensing means for sensing a parameter related to the air-fuel ratio of an air-fuel mixture formed by the carburetor, air bleed passage means communicating with the atmosphere and with said fuel supply passage means, control valve means movably located relative to said air bleed passage means for controlling the flow of air drawn into said fuel supply passage means through said air bleed passage means, said control valve means having first and second positions in which said control valve means closes and opens said air bleed passage means thereby to increase and reduce, respectively, the flow of fuel drawn from said fuel supply passage means into the intake passageway and to reduce and increase, respectively, the air-fuel ratio of an air-fuel mixture formed by the carburetor to a predetermined air-fuel ratio, solenoid means for operating said control valve means, control circuit means electrically connected to said sensing means for generating a first signal in response to said parameter sensed by said sensing means, which parameter has values corresponding to air-fuel ratios above said predetermined air-fuel ratio and for generating a second signal in response to said parameter sensed by said sensing means which parameter as values corresponding to air-fuel ratios below said predetermined air-fuel ratio, wiring means for electrically interconnecting said solenoid means and said control circuit means so that said solenoid means causes, in response to said first and second signals, said control valve means to move into said first and second positions, respectively, switch means responsive to the temperature of the engine and located in said wiring means to divide it into two sections, said switch means connecting said two sections to each other in response to temperatures of the engine which are above a predetermined value and disconnecting said two sections from each other in response to temperatures of the engine which are below said predetermined value, and means for causing said control valve means to move into said first position in response to disconnection of said two sections from each other.

8. An air-fuel ratio control system in combination with an internal combustion engine including a carburetor having:

an intake passageway and fuel supply passage means communicating with a fuel source and with the intake passageway and from which fuel is drawn into the intake passageway to form an air-fuel mixture, said air-fuel ratio control system comprising:

sensing means for sensing a parameter related to the air-fuel ratio of an air-fuel mixture formed by the carburetor, air bleed passage means communicating with the atmosphere and with said fuel supply passage means, control valve means movably located relative to said air bleed passage means for controlling the flow of air drawn into said fuel supply passage means through said air bleed passage means, said control valve means having first and second positions in which said control valve means closes and opens said air bleed passage means thereby to increase and reduce, respectively, the flow of fuel drawn from said fuel supply passage means into the intake passageway and to reduce and increase the air-fuel ratio of an air-fuel mixture formed by the carburetor to a predetermined air-fuel ratio, respectively, solenoid means for, when energized, moving said control valve means into said second position, biasing means for urging said control valve means into said first position, control circuit means electrically connected to said sensing means for generating an electrical signal in response to said parameter sensed by said sensing means which parameter has values corresponding to air-fuel ratios below said predetermined air-fuel ratio and for preventing generation of an electrical signal in response to said parameter sensed by said sensing means which parameter has values corresponding to air-fuel ratios above said predetermined air-fuel ratio, said solenoid means being electrically connected to said control circuit means so that said solenoid is energized by said electric signal from said control circuit to move said control valve means into said second position and is deenergized in response to the absence of said electrical signal from said control circuit means to allow said biasing means to move said control valve means into said first position, an electric power source, an electrical circuit connecting said electric power source to said control circuit means for feeding electric power, and switch means responsive to the temperature of the engine and located in said electric circuit for closing said circuit in response to temperatures of the engine which are above a predetermined value and for opening said electric circuit in response to temperatures of the engine which are below said predetermined value to deenergize said solenoid means to allow said biasing means to move said control valve means into said first position.

9. An air-fuel ratio control system in combination with an internal combustion engine including a carburetor having:

an intake passageway and fuel supply passage means communicating with a fuel source and with the intake passageway and from which fuel is drawn into the intake passageway to form an air-fuel mixture, said air-fuel ratio control system comprising:

sensing means for sensing a parameter related to the air-fuel of an air-fuel mixture formed by the carburetor, air bleed passage means cmmunicating with the atmosphere and with said fuel supply passage means, control valve means movably located relative to said air bleed passage means for controlling the flow of air drawn into said fuel supply passage means through said air bleed passage means, said control valve means having first and second positions in which said control valve means closes and opens said air bleed passage means thereby to increase and reduce, respectively, the flow of fuel drawn from said fuel supply passage means into the intake passageway and to reduce and increase the air-fuel ratio of an air-fuel ratio, respectively, solenoid means for, when energized, moving said control valve means into said second position, biasing means for urging said control valve means into said first position control circuit means electrically connected to said sensing means for generating an electrical signal in response to said parameter sensed by said sensing means which parameter has values corresponding to air-fuel ratios below said predetermined air-fuel ratio and for preventing generation of an electric signal in response to said parameter sensed by said sensing means which parameter has values corresponding to air-fuel ratios above said predetermined air-fuel ratio, an electric circuit including said solenoid means and said control circuit means whereby said solenoid means is energized by said electrical signal therefrom to move said control valve means into said second position and said solenoid means is deenergized in response to the absence of said electric signal from said control circuit means to allow said biasing means to move said control valve means into said first position, and switch means responsive to the temperature of the engine and located in said electric circuit for closing it in response to temperatures of the engine which are above a predetermined value and for opening said electric circuit in response to temperatures of the engine which are below said predetermined value to deenergize said solenoid means to allow said biasing means to move said control valve means into said first position.

10. The air-fuel ratio control system of claim 6 wherein the engine includes an air intake system and a cooling system and wherein the switch means comprises:

a first switch located in the cooling system for reacting to the temperature of coolant in the cooling system, and a second switch located in the air intake system for reacting to the temperature of intake air.

* * * * *